US005451359A

United States Patent [19]

Yahata et al.

[11] Patent Number: 5,451,359

[45] Date of Patent: Sep. 19, 1995

[54] PROCESS FOR PRODUCING HIGH MOLECULAR WEIGHT POLYESTER FIBERS

[75] Inventors: Kazuo Yahata; Ryoji Tsukamoto, both of Iwakuni, Japan

[73] Assignee: Teijin Limited, Osaka, Japan

[21] Appl. No.: 213,236

[22] Filed: Mar. 15, 1994

[30] Foreign Application Priority Data

Mar. 24, 1993 [JP] Japan ..... 5-065319

[51] Int. Cl.[6] ..... D01F 6/62

[52] U.S. Cl. ..... 264/203; 264/178 F; 264/210.5; 264/210.8; 264/211.15; 264/211.16; 264/211.17; 264/233; 264/235.6

[58] Field of Search ..... 264/203, 178 F, 210.5, 264/210.8, 211.15, 211.16, 211.17, 233, 235.6

[56] References Cited

U.S. PATENT DOCUMENTS

| | | | |
|---|---|---|---|
| 2,924,500 | 2/1960 | Huffman et al. | 264/203 X |
| 2,924,501 | 2/1960 | Wagner et al. | 264/203 X |
| 2,924,502 | 2/1960 | Ucci et al. | 264/203 X |

FOREIGN PATENT DOCUMENTS

| | | | |
|---|---|---|---|
| 336556 | 10/1989 | European Pat. Off. . | |
| 359692 | 3/1990 | European Pat. Off. | 264/203 |
| 61-207616 | 9/1986 | Japan . | |
| 62-30024 | 2/1987 | Japan . | |
| 63-12715 | 1/1988 | Japan . | |
| 4-73212 | 3/1992 | Japan . | |
| 2229187 | 9/1990 | United Kingdom . | |
| 2230732 | 10/1990 | United Kingdom . | |

OTHER PUBLICATIONS

Patent Abstracts of Japan, vol. 12 No. 148 (C-493) 7 May 1988 & JP-A-62 263 317 (Mitsubishi Rayon Co., Ltd.).

Patent Abstracts of Japan, vol. 11, No. 43 (C-402) 7 Feb. 1987 & JP-A-61 207 616 (Teijin Ltd.)

Database WPI Section Ch, Week 7924, Derwent Publications Ltd., London, GB; Class A, AN 79-44895B & JP-A-54 055 622.

Journal of Applied Polymer Science vol. 40, 1257-1263, 1990 SEN-I Gakkaishi, vol. 48, No. 10 569-575, 1992.

*Primary Examiner*—Leo B. Tentoni

*Attorney, Agent, or Firm*—Burgess, Ryan and Wayne

[57] ABSTRACT

High molecular weight polyester fibers having excellent mechanical strength and useful for various industrial materials, is produced by dry-jet wet spinning a dope solution of a polyester resin comprising repeating ethylene terephthalate units, having an intrinsic viscosity of 1.2 or more and dissolved in a phenolic solvent, through a spinneret, coagulating the resultant filamentary dope solution streams in a bath of coagulating liquid in which the phenolic solvent is soluble and the polyester resin is insoluble, while controlling the temperature of the coagulating liquid to a level of from (Tg−50° C.) to (Tg+45° C.) wherein Tg represents a glass transition temperature of the dope solution, and optionally subjecting the resultant undrawn polyester filaments to a rinsing step with a rinsing liquid, to a drawing step at a total draw ratio of at least 5, and to a heat-treating step.

14 Claims, No Drawings

PROCESS FOR PRODUCING HIGH MOLECULAR WEIGHT POLYESTER FIBERS

BACKGROUND OF THE INVENTION

1. Field of the Invention

The present invention relates to a process for producing high molecular weight polyester fibers. More particularly, the present invention relates to a process for producing polyester fibers with a high molecular weight corresponding to an intrinsic viscosity of 1.2 or more and having excellent mechanical properties, by a dry-jet wet spinning method.

2. Description of the Related Art

It is well known that polyester fibers, especially polyethylene terephthalate fibers have well-balanced physical and chemical properties and high spinning and drawing properties and thus are widely useful not only for various cloths but also for industrial uses. Particularly, polyester fibers having a high tensile strength are useful for various industrial materials, for example, tire cords.

Usual polyester fibers are produced by a melt-spinning (fiber-forming) method which is economically advantageous. Accordingly, to produce polyester fibers having a high tensile strength and useful for industrial materials, generally, a polyester polymer having a high degree of polymerization is melt-spun and the resultant undrawn filaments are drawn at a high draw ratio. However, the polyester polymers which can be formed into filaments by the usual melt-spinning method are limited to those having a melt viscosity of a certain upper limit value or less. Namely, it is difficult to produce undrawn polyester filaments substantially capable of being drawn from a polyester polymer having an intrinsic viscosity of 1.2 or more by the melt-spinning method. Therefore, it is very difficult to industrially produce polyester fibers having a high tensile strength exceeding 9 g/dtex (10 g/denier) by the melt-spinning method.

Japanese Unexamined Patent Publications (Kokai) Nos. 61-207,616, 62-30,024 and 4-73,212 disclose methods of producing polyester fibers from a polyester resin having a high degree of polymerization by dissolving the polyester resin in an organic solution and subjecting the resultant dope solution to a wet-type or dry-type filament-forming procedure.

In the methods of Japanese Unexamined Patent Publication (Kokai) Nos. 61-207,616 and 4-73,212, dichloroacetic acid and hexafluoropropanol are used as solvents for the polyester. The dichloroacetic acid exhibits a high degree of acidity and thus there are restrictions in handling of the dope solution and in types of materials usable for the spinning apparatus. Also, the hexafluoropropanol is disadvantageous in high price thereof. Therefore, the above-mentioned methods are difficult to be industrially utilized.

In the method of Japanese Unexamined Patent Publication No. 62-30,024, nitrobenzene is used as a solvent for the dope solution.

This method is, however, disadvantageous in that the dissolution of the polymer in nitrobenzene must be carried out at an undesirably high temperature of 200° C. or more which unavoidably causes the degree of polymerization of the polymer to reduce during the dissolution.

SUMMARY OF THE INVENTION

An object of the present invention is to provide a process for producing high molecular weight polyester fibers having a high tensile strength exceeding 10 g/denier (9 g/dtex) or more which is never obtained by a conventional melt-spinning process, from a high molecular weight polyester by a practical dry-jet wet spinning method.

The above-mentioned object can be attained by the process of the present invention for producing high molecular weight polyester fibers by a dry-jet wet spinning method, which process comprises the steps of:

preparing a spinning dope solution by dissolving a polyester resin comprising, as principal repeating units, repeating ethylene terephthalate units and having an intrinsic viscosity of 1.2 or more, determined in a solvent consisting of 40 parts by weight of p-chlorophenol and 60 parts by weight of 1,1,2,2-tetrachloroethane at a temperature of 35° C. in a solvent comprising, as a principal component, at least one phenolic compound;

extruding the spinning dope solution through a spinneret to form one or more filamentary streams of the extruded spinning dope solution; and introducing the filamentary dope solution streams into a coagulating liquid in which the solvent for the dope solution is soluble and the polyester resin is insoluble, to coagulate the filamentary dope solution streams and to form undrawn polyester filaments, the temperature of the coagulating liquid being controlled to a level within the range of from (Tg−50° C.) to (Tg+45° C.) wherein Tg represents a glass transition temperature of the dope solution.

DESCRIPTION OF THE PREFERRED EMBODIMENTS

In the process of the present invention, a polyester resin having a high molecular weight is dissolved in a solvent to provide a spinning dope solution, and the dope solution is converted to undrawn polyester filaments. The polyester resin comprises, as principal repeating units, repeating ethylene terephthalate units. The polyester resin is a substantially linear polymer produced from a dicarboxylic acid component comprising, as a main component, terephthalic acid and a diol component comprising, as a main component, ethylene glycol.

The polyester resin usable for the process of the present invention preferably comprises 60 to 100 molar %, more preferably 80 to 100 molar %, of repeating ethylene terephthalate units. Namely, the polyester resin may contain 0 to 40 molar %, preferably 0 to 20 molar %, of repeating units other than the repeating units. The other repeating ethylene terephthalate units are derived from a carboxylic acid component other than terephthalic acid, and a diol component other than ethylene glycol. The other carboxylic acid component comprises at least one member selected from the group consisting of aromatic dicarboxylic acids, for example, isophthalic acid, naphthalene dicarboxylic acid, diphenyldicarboxylic acid, and diphenyletherdicarboxylic acid; aliphatic dicarboxylic acids, for example, succinic acid, adipic acid, sebacic acid, and decanedicarboxylic acid; cycloaliphatic dicarboxylic acids, for example, hexahydroterephthalic acid, decalindicarboxylic acid and tetralindicarboxylic acid; and hydroxycarboxylic acids, for example, glycolic acid and p-hydroxybenzoic acid.

The other diol component comprises at least one member selected from the group consisting of aliphatic diols, for example, trimethylene glycol, propylene glycol, 1,4-butanediol, 1,3-butanediol, neopentyl glycol and 1,6-hexanediol; and cycloaliphatic diols, for example, cyclohexanedimethanol and tricyclodecanedimethanol.

A most preferable polyester for the process of the present invention is a polyethylene terephthalate homopolymer.

The polymer resin usable for the process of the present invention may contain at least one member selected from ultraviolet ray-absorbing agents, antioxidants, stabilizers, plasticizers, lubricants, flame-retardants, releasing agents and pigments.

The polyester resin usable for the process of the present invention has an intrinsic viscosity of 1.2 or more, determined in a solvent consisting of a mixture of p-chlorophenol and 1,1,2,2-tetrachloroethane in a mixing ratio of 40:60 by weight at a temperature of 35° C. If a polyester resin having an intrinsic viscosity of less than 1.2 is employed, the resultant polyester fibers do not exhibit satisfactorily high mechanical properties. Preferably, the polyester resin has an intrinsic viscosity of 1.5 to 5.0.

In the process of the present invention, the above-mentioned specific high molecular weight polyester resin is dissolved in a solvent comprising, as a principal component, at least one phenolic compound, to provide a spinning dope solution, and then the dope solution is subjected to filament-forming procedures by a dry-jet wet spinning method in which the dope solution is extruded through a spinneret and the resultant filamentary streams of the dope solution is coagulated in a specific coagulating liquid.

The phenolic compound usable, as a solvent, for preparing the spinning dope solution is preferably selected from the group consisting of phenol, o-chlorophenol, m-chlorophenol, p-chlorophenol, 2,4-dichlorophenol and 2,4,6-trichlorophenol. These phenolic compounds can be employed alone or as a mixture of two or more thereof. Among the above-mentioned compounds, p-chlorophenol and 2,4-dichlorophenol are more preferably employed for the process of the present invention.

In the solvent for the dope solution, the phenolic compound may be mixed with a co-solvent compatible with the phenolic compound. The co-solvent may comprise at least one member selected from, for example, 1,1,2,2-tetrachloroethane, chloroform and dichloromethane. Preferably, the content of the co-solvent in the solvent for the dope solution is 50% by weight or less, more preferably 40% by weight or less, based on the total weight of the solvent.

In the dope solution usable for the process of the present invention, the content of the polyester resin is preferably 5 to 50% by weight, more preferably 10 to 35% by weight. When the content of the polyester resin is more than 50% by weight, sometimes it becomes difficult to completely dissolve the entire amount of the polyester resin in the solvent. Also, if the content of the polyester resin is less than 5% by weight, the resultant dope solution sometimes has too low a viscosity and thus exhibits an unsatisfactorily poor stringiness, namely filament-forming property.

Preferably, the dissolution of the polyester resin in the solvent for preparing the dope solution, is carried out at a temperature of 200° C. or less, preferably 100° C. to 180° C. When the dissolving temperature for the polyester resin is more than 200° C., sometimes, it causes a high risk of reducing the degree of polymerization of the polyester resin.

The dope solution prepared in the above-mentioned manner is converted to amorphous (non-crystalline) undrawn filaments by a dry-jet wet spinning method in which the dope solution is extruded through a spinneret having one or more spinning orifices, into the ambient air atmosphere or another gas atmosphere, for example, a nitrogen gas atmosphere, by using an extruder, and the resultant filamentary streams of the dope solution are introduced into a specific coagulating liquid bath to solidify the dope solution streams.

In the process of the present invention, the spinning temperature, namely a temperature at which the dope solution passes through the spinning orifices, is preferably 20° C. to 120° C. When the spinning temperature falls outside of the above-mentioned range, the extruded dope solution streams sometimes exhibit an unsatisfactorily poor filament-forming property.

The distance between the outlet end of the spinneret and the coagulating liquid bath surface is preferably adjusted to 1 mm to 100 mm, more preferably 5 mm to 50 mm.

In the process of the present invention, the coagulating liquid comprises at least one compound which is capable of dissolving therein the solvent for the dope solution and not capable of dissolving the polyester resin therein. The coagulating compound usable for the process of the present invention is preferably selected from aliphatic alcohols having 1 to 6 carbon atoms, for example, methyl alcohol, ethyl alcohol, propyl alcohol, isobutyl alcohol, and n-butyl alcohol; aliphatic ketones having 3 to 5 carbon atoms, for example, acetone and methylethyl ketone; ethers, for example, ethyl ether, and tetrahydrofuran; and glycols having 2 to 4 carbon atoms, for example, ethylene glycol and propylene glycol. Those compounds can be employed alone or in a mixture of two or more thereof. Among the above mentioned coagulating compounds, the aliphatic alcohols are more preferably employed and methyl alcohol is most preferably employed. The coagulating liquid necessarily has a melting temperature lower than the coagulating liquid temperature at which the dope solution streams are coagulated.

In the process of the present invention, the temperature of the coagulating liquid is controlled to a level of from 50° C. below Tg to 45° C. above Tg, namely from (Tg−50° C.) to (Tg+45° C.), wherein Tg represents a glass-transition temperature in °C. of the dope solution. Preferably, the coagulating liquid temperature is in the range of from (Tg−30° C.) to (Tg+10° C.).

For example, a dope solution consisting of 20 parts by weight of polyethylene terephthalate and 80 parts by weight of p-chlorophenol has a glass-transition temperature (Tg) of −49° C. Therefore, where this dope solution is used for the process of the present invention, the coagulating liquid temperature is controlled to a level of from −99° C. to −4° C., preferably from −79° C. to −39° C.

Preferably, the dope solution usable for the process of the present invention has a glass transition temperature (Tg) of from −80° C. to −10° C., more preferably from −70° C. to −20° C.

The glass transition temperature (Tg) of the dope solution can be determined according to JIS 7121 by using a differential scanning calorimeter at a temperature-raising rate of 10° C./min.

The coagulated, undrawn polyester filaments have an excellent homogeneity and transparency, a high amorphous property, and a very high drawability, and thus can be smoothly drawn in a liquid similar to the coagulating liquid or in the ambient air atmosphere.

In the process of the present invention, the above-mentioned specific dope solution and the extruding and coagulating steps using the specific coagulating liquid at a specific coagulating liquid temperature effectively cause the high molecular weight polyester resin to be smoothly formed into polyester amorphous filaments without reducing the molecular weight thereof by the dry-jet, wet spinning method. The polyester filaments having the high molecular weight are useful for producing polyester filaments having a high degree of orientation and a excellent mechanical strength.

The coagulated undrawn polyester filaments are withdrawn from the coagulating liquid and subjected to other steps. The withdrawn undrawn polyester filaments preferably has a content of the solvent remaining therein of 10% by weight or less, more preferably 0 to 5% by weight, based on the weight of the polyester resin.

The undrawn polyester filaments are optionally subjected to a rinsing step with a rinsing liquid having a similar composition to that of the coagulating liquid or with water, to remove the solvent remaining in the filaments, and then the rinsed filaments are dried preferably at a temperature of 100° C. or less. The dried polyester filaments having a dense solid structure are obtained in an amorphous state. Before the drying step, the rinsed filaments are optionally further rinsed with water. The dried undrawn polyester filaments can be drawn and heat-set in a conventional manner, for example, a multi-step drawing process which is applied to undrawn polyester filaments produced by a conventional melt-spinning method.

Preferably, the total draw ratio applied to the undrawn polyester filament is 5.0 or more, more preferably 7.0 to 15.0. The total draw ratio is a product of a draw ratio applied to the polyester filaments before drying with a draw ratio applied to the dried polyester filaments.

Where the undrawn polyester filaments are drawn in the multistep drawing process, a first drawing step is carried out preferably at a temperature of from 40° C. to 100° C. in the air atmosphere or from room temperature to 90° C. in water, and a second drawing step is carried out at a temperature higher than that of the first drawing step but not higher than 250° C.

The above-mentioned drawing procedure at the high total draw ratio of 5.0 or more effectively causes the resultant drawn polyester filaments to exhibit a high degree of orientation and thus excellent mechanical properties. For example, the polyester filaments produced in accordance with the process of the present invention under certain conditions exhibit a tensile strength of more than 10.8 g/dtex (12 g/denier).

The drawn polyester filaments are preferably heat-set at a temperature of from 150° C. to 260° C. During the heat-setting procedure, the solvent remaining in the filaments are completely removed, if any.

The high molecular weight polyester filaments or fibers produced in accordance with the process of the present invention are useful for various industrial materials due to the excellent mechanical properties thereof.

EXAMPLES

The process of the present invention will be further illustrated by way of specific examples which are merely representative and do not restrict the scope of the present invention in any way.

In the examples, the following measurements were carried out.

(1) Intrinsic viscosity

The intrinsic viscosity of polyester resin was determined, using a solution thereof in a concentration of 0.5 g/100 ml in a solvent consisting of a mixture of p-chlorophenol with 1,1,2,2-tetrachloroethane in a mixing weight ratio of 40:60 at a temperature of 35° C.

(2) Tensile properties

The tensile strength, elongation at break and Young's modulus of polyester filaments were determined by using a tensile tester in which a filament specimen having a testing length of 25 mm was stretched at a constant stretching speed of 80% per minute.

(3) Glass transition temperature of dope solution was determined by using a differential scanning calorimeter (DSC) in a nitrogen gas stream at a temperature-raising rate of 10° C. per minute.

(4) Crystallinity

The crystallinity of polyester filaments was evaluated in accordance with a wide angle X-ray diffraction pattern thereof.

EXAMPLE 1

A polyethylene terephthalate polymer having an intrinsic viscosity of 2.30 was prepared by a solid phase polymerization method at a temperature of 250° C. under a reduced pressure.

The polyethylene terephthalate polymer was dissolved in a concentration of 24% by weight in p-chlorophenol at a temperature of 130° C. The resultant spinning dope solution had a glass transition temperature (Tg) of −47° C.

The spinning solution was subjected to a dry-jet wet wet spinning process in which the dope solution was supplied to a plunger extruder and extruded at a temperature of 70° C. through a spinneret of the extruder. The spinneret had one single spinning orifice having a diameter of 0.15 mm, and the extruding linear rate of the dope solution was 2 m/minute. The extruded filamentary stream of the dope solution was introduced into a coagulating bath consisting of methyl alcohol and having a coagulating liquid temperature of −70° C. through an air atmosphere. A distance between the outlet end of the spinneret and the coagulating liquid surface was 3 cm. The resident time of the undrawn filament in the coagulating bath was about 60 seconds. The resultant undrawn polyester filament was taken up from the coagulating bath at a speed of 2.2 m/min. The undrawn polyester filament was subjected to a wide angle X-ray diffractometry. From the resultant wide angle X-ray diffraction pattern, it was confirmed that the resultant undrawn polyester filament was amorphous (non-crystalline).

The undrawn polyester filament was rinsed with methyl alcohol at a temperature of 10° C. and dried by using drying rollers while maintaining the length of the filament constant. The dried polyester filament was drawn in hot air at a draw ratio of 5.0 at a temperature of 100° C. and then at a draw ratio of 1.7 at a temperature of 200° C.

The resultant drawn polyester filament had a tensile strength of 11.25 g/dtex (12.5 g/denier), an elongation at break of 11.0% and a Young's modulus of 135 g/dtex (150 g/denier). Also, the drawn polyester filament exhibited an intrinsic viscosity of 2.00 which was close to that of the polyester resin.

EXAMPLE 2

A drawn polyester filament was produced by the same procedures as in Example 1 except that the coagulating bath consisted of acetone having a temperature of −60° C., and the undrawn polyester filament was dried while keeping it at a constant length thereof, and thereafter drawn at a draw ratio of 4.0 at a temperature of 100° C. and then at a draw ratio of 1.7 at a temperature of 200° C.

The resultant drawn polyester filament had a tensile strength of 9.18 g/dtex (10.2 g/denier), an elongation at break of 9.5% and a Young's modulus of 126 g/dtex (140 g/denier) and exhibited an intrinsic viscosity of 2.00.

Comparative Example 1

The same procedures as in Example 1 were carried out except that the temperature of the coagulating bath consisting of methyl alcohol was changed to 40° C. The resultant undrawn polyester filament had a number of voids therein and appeared white. In view of an X-ray diffraction pattern, it was confirmed that the undrawn polyester filament was crystallized. The undrawn polyester filament had a very poor drawability and thus was failed to be converted to a drawn polyester filament having a high tensile strength.

EXAMPLE 3

A polyethylene terephthalate polymer having an intrinsic viscosity of 2.50 was prepared by a solid phase polymerization method at a temperature of 240° C. under a reduced pressure.

The polyethylene terephthalate polymer was dissolved in a concentration of 22.5% by weight in p-chlorophenol at a temperature of 140° C. The resultant spinning dope solution had a glass transition temperature (Tg) of −48° C.

The spinning solution was subjected to a dry-jet, wet spinning process in which the dope solution was supplied to a plunger extruder and extruded at a temperature of 60° C. through a spinneret of the extruder. The spinneret had one single spinning orifice having a diameter of 0.08 mm, and the extruding linear rate of the dope solution was 4.5 m/minute. The extruded filamentary stream of the dope solution was introduced into a coagulating bath consisting of methyl alcohol and having a coagulating liquid temperature of −50° C. through an air atmosphere. A distance between the outlet end of the spinneret and the coagulating liquid surface was 2 cm. A resultant undrawn polyester filament having a thickness of 14.4 dtex (13 denier) was taken up from the coagulating bath at a speed of 5 m/min. The undrawn polyester filament was subjected to wide angle X-ray diffractometry. From the resultant wide angle X-ray diffraction pattern, it was confirmed that the resultant undrawn polyester filament was amorphous (non-crystalline).

The undrawn polyester filament was rinsed with methyl alcohol at a temperature of 15° C. and dried by using drying rollers while maintaining the length of the filament constant. The dried polyester filament was drawn in hot water at a draw ratio of 7.4 at a temperature of 80° C. and then heat-set in hot air at a temperature of 200° C., while keeping the filament at a constant length.

The resultant drawn polyester filament had a tensile strength of 11.52 g/dtex (12.8 g/denier), an elongation at break of 11.3% and a Young's modulus of 157.5 g/dtex (175 g/denier). Also, the drawn polyester filaments exhibited an intrinsic viscosity of 2.05.

EXAMPLE 4

The same procedures as in Example 3 were carried out, except that the dried, undrawn polyester filaments were drawn at a draw ratio of 3.5 in a hot water bath at a temperature of 60° C., and then further drawn at a draw ratio of 2.1 on a heated plate at a temperature of 230° C.

The resultant drawn polyester filament had a tensile strength of 10.2 g/dtex (11.3 g/denier), an elongation at break of 7.5% and a Young's modulus of 135 g/dtex (150 g/denier), and exhibited an intrinsic viscosity of 2.05.

Comparative Example 2

A polyethylene terephthalate polymer having an intrinsic viscosity of 1.0 was dissolved in a concentration of 28% by weight in p-chlorophenol at a temperature of 140° C.

The resultant dope solution was extruded by using the same plunger extruder as in Example 3 at a temperature of 80° C. and the extruded filamentary stream of the dope solution was introduced into a coagulating bath consisting of methyl alcohol and having a temperature of −50° C. The resultant coagulated polyester filament had a very poor mechanical strength and thus could not be wound up from the coagulated bath.

We claim:

1. A process for producing high molecular weight polyester fibers by a dry-jet wet spinning method, comprising the steps of:

preparing a spinning dope solution by dissolving a polyester resin comprising, as principal repeating units, repeating ethylene terephthalate units and having an intrinsic viscosity of at least 1.2, determined in a solvent consisting of 40 parts by weight of p-chlorophenol and 60 parts by weight of 1,1,2,2-tetrachloroethane at a temperature of 35° C., in a solvent comprising, as a principal component, at least one phenolic compound, said spinning dope solution having a glass transition temperature ($T_g$) of from −80° C. to −10° C.;

dry-jet wet spinning said spinning dope solution by extruding said spinning dope solution through a spinneret to form at least one filamentary streams of the extruded spinning dope solution, and introducing the at least one filamentary dope solution stream into a coagulating liquid in which the solvent for the dope solution is soluble and the polyester resin is insoluble, to coagulate the filamentary dope solution stream and to form at least one undrawn polyester filament, the temperature of the coagulating liquid being controlled to a level within the range of from (Tg−50° C.) to (Tg+10° C.) in which Tg represents the glass transition temperature of the dope solution.

2. The process as claimed in claim 1, wherein the polyester resin comprises 60 to 100 molar % of repeating ethylene terephthalate units and 0 to 40 molar % of repeating units other than the repeating ethylene terephthalate units.

3. The process as claimed in claim 1, wherein the solvent for the dope solution comprises 50 to 100% by weight of at least one phenolic compound selected from the group consisting of phenol, o-chlorophenol, m-chlorophenol, p-chlorophenol, 2,4-dichlorophenol and 2,4,6-trichlorophenol, and 0 to 50% by weight of at least one co-solvent selected from the group consisting of 1,1,2,2-tetrachloroethane, chloroform, and dichloromethane.

4. The process as claimed in claim 1, wherein the polyester resin is present in a concentration of 5 to 50% by weight in the dope solution.

5. The process as claimed in claim 1, wherein the polyester resin is dissolved in the solvent at a temperature not higher than 200° C.

6. The process as claimed in claim 1, wherein the at least one extruded filamentary dope solution stream travels through an ambient air atmosphere or another gas atmosphere and is then introduced into the coagulating liquid in accordance with the dry-jet wet spinning method.

7. The process as claimed in claim 1, wherein the dope solution is extruded through the spinneret at a temperature controlled to a level of from 20° C. to 120° C.

8. The process as claimed in claim 6, wherein a distance between an outlet end of the spinneret and an upper surface of the coagulating liquid is 1 to 100 mm.

9. The process as claimed in claim 6, wherein the coagulating liquid comprises at least one member selected from the group consisting of aliphatic alcohols having 1 to 6 carbon atoms, aliphatic ketones having 3 to 5 carbon atoms, and glycols having 2 to 4 carbon atoms.

10. The process as claimed in claim 1, wherein the at least one coagulated, undrawn polyester filament withdrawn from the coagulating liquid has a content of the solvent remaining in the at least one filament not above 10% by weight based on the weight of the polyester resin.

11. The process as claimed in claim 1, which further comprises rinsing the at least one coagulated undrawn polyester filament with a rinsing liquid the same as the coagulating liquid, or with water.

12. The process as claimed in claim 1, which further comprises drawing the at least one coagulated undrawn polyester filament, in at least one drawing step.

13. The process as claimed in claim 10, wherein the drawing step is carried out at a total draw ratio of 5 or more.

14. The process as claimed in claim 10, which further comprises heat-treating the at least one drawn polyester filament.

* * * * *